US008898814B2

(12) United States Patent
Storms, Jr. et al.

(10) Patent No.: US 8,898,814 B2
(45) **Date of Patent: *Dec. 2, 2014**

(54) RELEASABLE VEST

(75) Inventors: Frederick W. Storms, Jr., Newport News, VA (US); Marty Goldman, Virginia Beach, VA (US); Stephen Matulewicz, Moyock, NC (US); Eric M. Yeates, Virginia Beach, VA (US); Thomas A. Marx, Virginia, VA (US); David M. Jones, Virginia Beach, VA (US)

(73) Assignee: Alliant Techsystems Inc., Minneapolis, MN (US)

( * ) Notice: Subject to any disclaimer, the term of this patent is extended or adjusted under 35 U.S.C. 154(b) by 788 days.

This patent is subject to a terminal disclaimer.

(21) Appl. No.: 12/735,479

(22) PCT Filed: Jan. 15, 2009

(86) PCT No.: PCT/US2009/000243

§ 371 (c)(1), (2), (4) Date: Oct. 12, 2010

(87) PCT Pub. No.: WO2009/126190

PCT Pub. Date: Oct. 15, 2009

(65) Prior Publication Data

US 2011/0023207 A1 Feb. 3, 2011

Related U.S. Application Data

(60) Provisional application No. 61/011,800, filed on Jan. 22, 2008.

(51) Int. Cl.

| | |
|---|---|
| ***F41H 1/02*** | (2006.01) |
| ***A41D 1/04*** | (2006.01) |
| *A41F 1/02* | (2006.01) |

(52) U.S. Cl.

CPC .. *A41D 1/04* (2013.01); *F41H 1/02* (2013.01); *A41D 2300/33* (2013.01); *A41F 1/02* (2013.01); *A41D 2400/44* (2013.01)

USPC ..... 2/102; 2/2.5

(58) Field of Classification Search

CPC ... A41D 1/067; A41D 1/084; A41D 2200/20; A41D 2300/30; A41D 2300/33; A41D 2400/10; A41D 2400/14; A41D 2400/26; A41D 2400/28; A41D 2400/34; A41D 2400/38; A41D 2400/482

USPC ..... 2/102, 2.5, 94, 455, 456, 459, 463, 464, 2/465, 467, 462, 48, 69, 460, 461, 44, 45, 2/50; 98/518; 428/911

See application file for complete search history.

(56) References Cited

U.S. PATENT DOCUMENTS 3,095,587 A * 7/1963 Whalen ..... 441/84
3,452,362 A * 7/1969 Korolick et al. ..... 2/2.5

(Continued)

OTHER PUBLICATIONS

U.S. Appl. No. 11/895,718, filed Aug. 2007, Storms, Frederick W.*

(Continued)

*Primary Examiner* — Clinton T Ostrup
*Assistant Examiner* — Catherine M Ferreira
(74) *Attorney, Agent, or Firm* — Shaddock Law Group, PC

(57) ABSTRACT

A releasable vest having a front panel; front shoulder strap elements that include at least one front shoulder strap attachment opening; a back panel; a first waist belt element and a second waist belt element that are releasably coupled to the front panel and extend from the front panel; at least one release loop that is capable of being passed through an opening formed in at least one of the waist belt elements and an opening formed in the front shoulder strap elements; and a release lanyard that is capable of being passed through the release loop so as to releasably secure the waist belt elements and the shoulder strap elements to the release loop.

20 Claims, 11 Drawing Sheets

(56) References Cited

U.S. PATENT DOCUMENTS

| | | | | |
|---|---|---|---|---|
| 5,148,582 | A * | 9/1992 | Dennis, Jr. | 24/625 |
| 5,617,582 | A * | 4/1997 | Burwell | 2/102 |
| 6,185,738 | B1 * | 2/2001 | Sidebottom | 2/2.5 |
| 6,446,273 | B1 * | 9/2002 | Gillen et al. | 2/455 |
| 6,769,137 | B2 * | 8/2004 | D'Annunzio | 2/102 |
| 6,948,188 | B2 * | 9/2005 | D'Annunzio | 2/102 |
| 7,020,897 | B2 * | 4/2006 | Johnson | 2/102 |
| 7,047,570 | B2 * | 5/2006 | Johnson | 2/102 |
| 7,243,376 | B2 * | 7/2007 | Johnson | 2/102 |
| 7,424,748 | B1 * | 9/2008 | McDunn et al. | 2/2.5 |
| 7,536,728 | B1 * | 5/2009 | Leathers | 2/2.5 |
| 7,917,967 | B2 * | 4/2011 | Osborne | 2/2.5 |
| 7,979,917 | B2 * | 7/2011 | Osborne | 2/2.5 |
| 7,987,523 | B2 * | 8/2011 | Cole et al. | 2/102 |
| 8,002,159 | B2 * | 8/2011 | Cragg | 224/579 |
| 8,418,265 | B1 * | 4/2013 | Storms et al. | 2/102 |
| 8,479,312 | B2 * | 7/2013 | Dovner et al. | 2/2.5 |
| 8,595,862 | B2 * | 12/2013 | Storms et al. | 2/2.5 |
| 2005/0005343 | A1 * | 1/2005 | Johnson | 2/102 |
| 2007/0079416 | A1 * | 4/2007 | Carlson | 2/2.5 |
| 2007/0107109 | A1 * | 5/2007 | Johnson | 2/102 |
| 2007/0289045 | A1 * | 12/2007 | Evans et al. | 2/102 |
| 2009/0282595 | A1 * | 11/2009 | Branson et al. | 2/2.5 |
| 2010/0223705 | A1 * | 9/2010 | Osborne | 2/2.5 |
| 2010/0287681 | A1 * | 11/2010 | Storms et al. | 2/102 |
| 2011/0179539 | A1 * | 7/2011 | Dovner et al. | 2/2.5 |
| 2012/0304355 | A1 * | 12/2012 | Dennis | 2/2.5 |

OTHER PUBLICATIONS

U.S. Appl. No. 12/733,011, filed Apr. 2010, Storms, Frederick W.*
U.S. Appl. No. 12/733,012, filed Apr. 2010, Storms, Frederick W.*

* cited by examiner

RELEASABLE VEST

CROSS-REFERENCE TO RELATED APPLICATIONS

This patent application claims the benefit of U.S. Patent Application Ser. No. 61/011,800, filed Jan. 22, 2008, the disclosure of which is incorporated herein by reference.

BACKGROUND OF THE INVENTION

1. Field of the Invention

This invention relates generally to releasable vests or carriers. In particular, the present invention relates to an improved releasable vest or carrier that is easier to operate and has components that, upon release by a user, are more likely to separate and fall away from the user than current releasable or cutaway vests.

2. Description of Related Art

Military and law enforcement personnel, particularly those attached to special operations unit, carry a large amount of specially designed and adapted gear on various vests or carriers. Because of the bulk and weight of certain tactical vests and body armor carriers, it is sometimes necessary or desirable to be able to quickly remove the vest or carrier, particularly in an emergency situation.

SUMMARY OF THE INVENTION

However, current releasable or cutaway vests typically include a multitude of components or panels that are connected via a plurality of release cords that are intricately woven between the components in order to keep the components connected.

In order for the various components or panels of a known, assembled cutaway vest to be released, the wearer must pull the release cord(s) a sufficient distance such that the release cord(s) becomes unwoven from the various components and releases each of the components. This is typically difficult as there is a great deal of friction between the release cord(s) and the cutaway vest components. Furthermore, the release cord(s) typically have to be pulled a great distance in order to fully release the cutaway vest components.

The release cord(s) typically comprise metal or plastic cords with a circular cross-section. While cords having a circular cross-section may be used, if a load is placed on the vest in an area above the location of one of the cords, a pressure point can be formed, making the vest uncomfortable for the wearer of the vest.

In many of the current cutaway vests, even after the release cord(s) have been removed from the vest, the vest components remain firmly coupled to one another via various large attachment areas, such as large portions of Velcro. Thus, the "released" components still remain firmly coupled to one another and must still be forcibly, manually separated from one another before the cutaway vest can be removed from the user.

Therefore, the present invention relates generally to releasable vests or carriers that are easier for a user to operate and have components that, upon release, are more likely to separate and fall away from the user than current cutaway vests.

In various exemplary, non-limiting embodiments, the releasable vest or carrier comprises at least some of a front panel, a back panel, and at least one waist belt element extending from or coupled to either the front panel or the back panel. A flexible release lanyard is used in combination with a release loop, such that when various components of the releasable vest or carrier are assembled, the components can be maintained in an assembled relationship. When the flexible release lanyard is pulled a predetermined distance, select components of the releasable vest or carrier are released from the assembled relationship and can fall away from the user.

In various exemplary, non-limiting embodiments, an additional safety lanyard may be included. In these exemplary embodiments, at least some of the components of the releasable vest or carrier cannot be released from the assembled relationship until both the safety lanyard and the release lanyard are pulled a predetermined distance.

Accordingly, this invention provides a releasable vest of improved design.

This invention separately provides a vest, which is capable of allowing a user to more efficiently release, or "cut away", the vest.

This invention separately provides a releasable vest, which, in certain exemplary embodiments, is capable of providing an increased level of security against accidental release.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
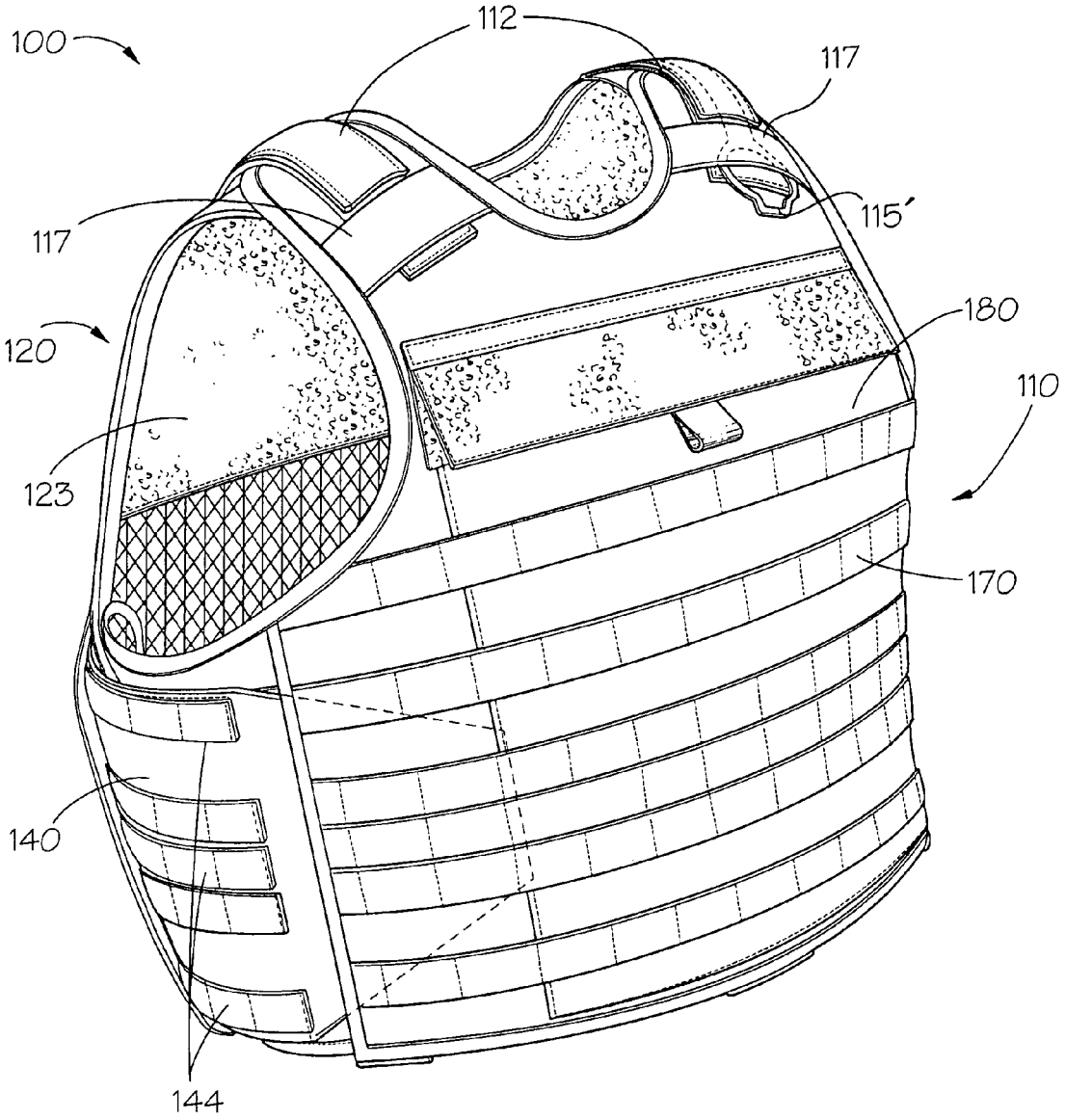
FIG. 1 shows a front perspective view of a first exemplary embodiment of a releasable vest according to this invention.
Figure 2:
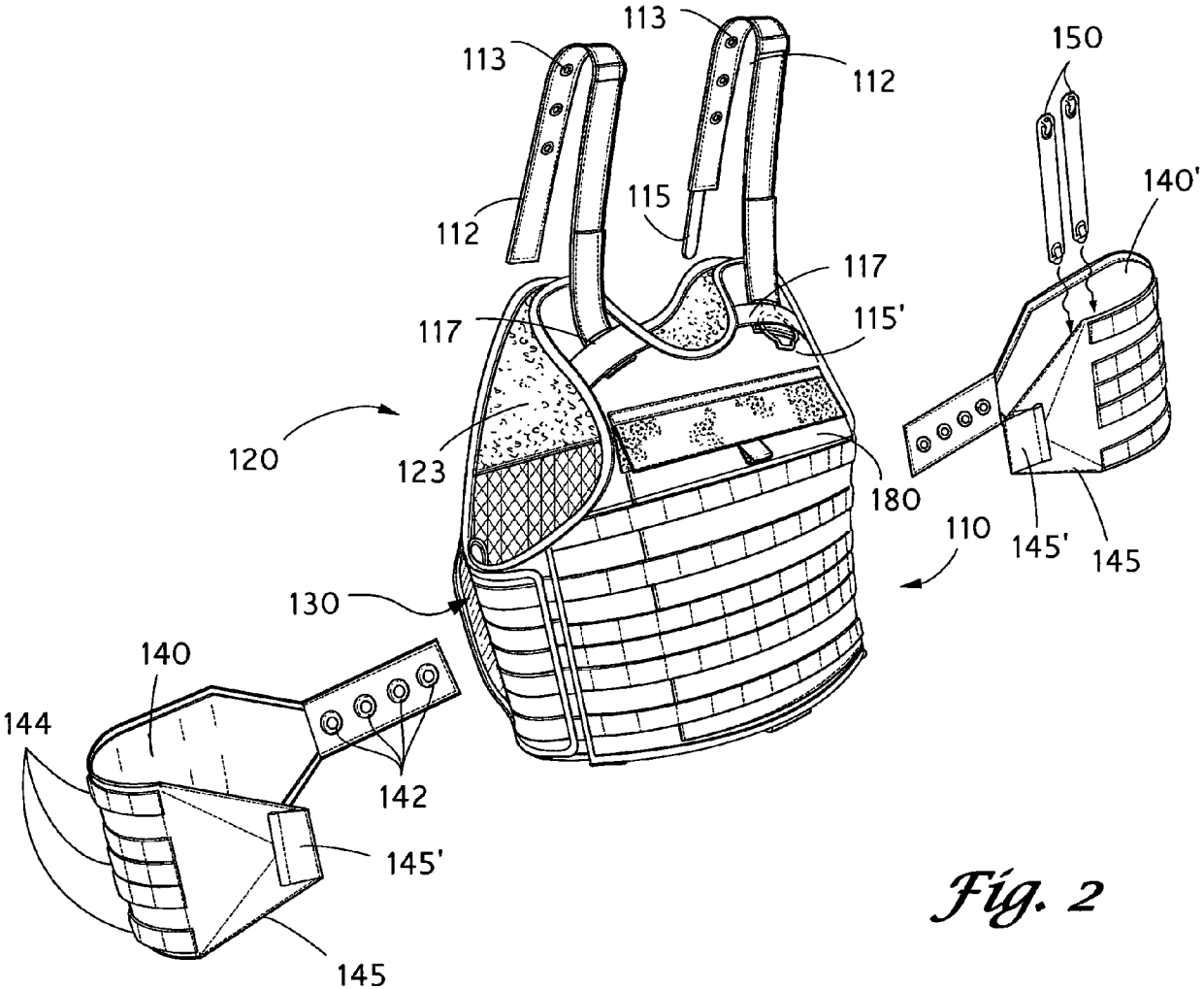
FIG. 2 shows a partially exploded front perspective view of a first exemplary embodiment of a releasable vest according to this invention.

For simplicity and clarification, the design factors and operating principles of the releasable vest of this invention are explained with reference to various exemplary embodiments of a releasable vest. The basic explanation of the design factors and operating principles of the releasable vest is applicable for the understanding, design, and operation of the releasable vest of this invention.

It should also be appreciated that, for simplicity and clarification, the embodiments of this invention will be described using the terms "front" and "back". However, it should be understood that these terms are merely used to aid in understanding of this invention are not to be construed as limiting the systems, methods, and apparatuses of this invention. Thus, it should be appreciated that the design factors and operating principles of the releasable vest described herein may be used in a "mirror image" releasable vest, where in the elements described as being included in or on the front are included in or on the back. Alternatively certain of the elements that are described as being included in or on the back of the releasable vast may be included in or on the front of the vest, or vice versa.

Furthermore, it should be appreciated that, for simplicity and clarification, the embodiments of this invention will be shown and/or described with reference to MOLLE and/or S.T.R.I.K.E.® compatible webbing being included on various portions of the releasable vest. However, it should be appreciated that the inclusion and/or placement of any MOLLE and/or S.T.R.I.K.E.® compatible webbing is not essential to the releasable vest of this invention. In various exemplary, non-limiting embodiments of this invention, the releasable vest may incorporate any type of known or later developed system capable of allowing any number of exterior pouches, pockets, carriers, or the like to be permanently or releasably coupled or attached to the vest. Alternatively, the design factors and principles of this invention may be utilized in a vest that does not include any exterior pouches, pockets, or carriers, but is used as, for example, a ballistic plate carrier or a floatation device.

It should also be appreciated that the terms "releasable vest", "vest", and "carrier" are used for basic explanation and understanding of the operation of the systems, methods, and apparatuses of this invention. Therefore, the terms "releasable vest", "vest", and "carrier" are not to be construed as limiting the systems, methods, apparatuses, and applications of this invention.

Turning now to the drawing figures, FIGS. 1 through 9 show various features of a first exemplary embodiment of a releasable vest according to this invention. As shown in the drawing figures, the releasable vest 100 includes at least some of a front panel 110, front shoulder strap elements 112, a back panel 120, a first waist belt element 140, a second waist belt element 140', a release loop 160, and a release lanyard 115.

The front panel 110 comprises at least a first layer 111 and a second layer 114, with a cavity formed between the first layer 111 and the second layer 114. An upper portion of the second layer 114 is attached or coupled to the first layer 111 at an upper portion of the first layer 111. In various exemplary embodiments, as illustrated herein, a lower portion of the second layer 114 extends beyond a point where the second layer 114 is attached or coupled to the first layer 111 to form a front panel flap portion 114' of the second layer 114.

The front panel flap portion 114' is formed so as to be secured or releasably coupled to the first layer 111 by a releasable coupler 116. In various exemplary embodiments, the releasable coupler 116 may comprise a hook and loop fastener, such as Velcro. It should be appreciated that, in various exemplary embodiments the releasable coupler 116 may comprise other releasable couplers or releasable fasteners, such as, for example, male/female snap-release buckles, a ziplock fastening device, a zipper, buttons, snaps, or other fastening, closure, or attachment means known by those skilled in the art.

In various exemplary embodiments, as illustrated herein, the front panel flap portion 114' may be formed so as to extend beyond a lower portion of the first layer 111 and be releasably coupled to a first side of the first layer 111 (a side of the front panel 110 that faces towards the body of a user wearing the releasable vest 100). Alternatively, the front panel flap portion 114' may be formed so as to be releasably coupled to a second side of the first layer 111 (a side of the front panel 110 that faces away from the body of a user wearing the releasable vest 100).

In various exemplary embodiments, the front panel 110 may also comprise an additional layer of material 122, which provides an additional cushioning or airflow layer to the front panel 110. Furthermore, the front panel 110 may comprise a portion of attachment material 123, such as, for example, a hook and loop fastener, such as Velcro. The inclusion of a portion of attachment material 123 may allow for the releasable attachment of certain additional components, such as, for example, collars or other protective portions, to the front panel 110 of the releasable vest 100.

The front panel 110 includes two front shoulder strap elements 112 that extend from an upper portion of the front panel 110. In various exemplary embodiments, the front shoulder strap elements 112 are formed as an integral part of the front panel 100. Alternatively, the front shoulder strap elements 112 may be coupled or attached to the front panel 110.

In various exemplary embodiments, each of the front shoulder strap elements 112 includes a plurality of front shoulder strap attachment openings 113. In various exemplary, non-limiting embodiments, the front shoulder strap attachment openings 113 comprise slits or openings formed through the material of the front shoulder strap elements 112.

In certain exemplary embodiments, the attachment openings 113 are reinforced by, for example, stitching, a grommet, or other reinforced eyelet.

The front shoulder strap attachment openings 113 allow the release loop 160 to pass through the front shoulder strap elements 112 (as discussed below). In various exemplary embodiments, a single attachment opening 113 may be included on each front shoulder strap element 112. However, a plurality of attachment openings 113 may be included to allow a user to select a single attachment opening 113 to pass the release loop 160 through, thereby providing a measure of adjustment to the effective length of the front shoulder strap elements 112 and the overall fit of the releasable vest 100.

Figures 3A, 3B:
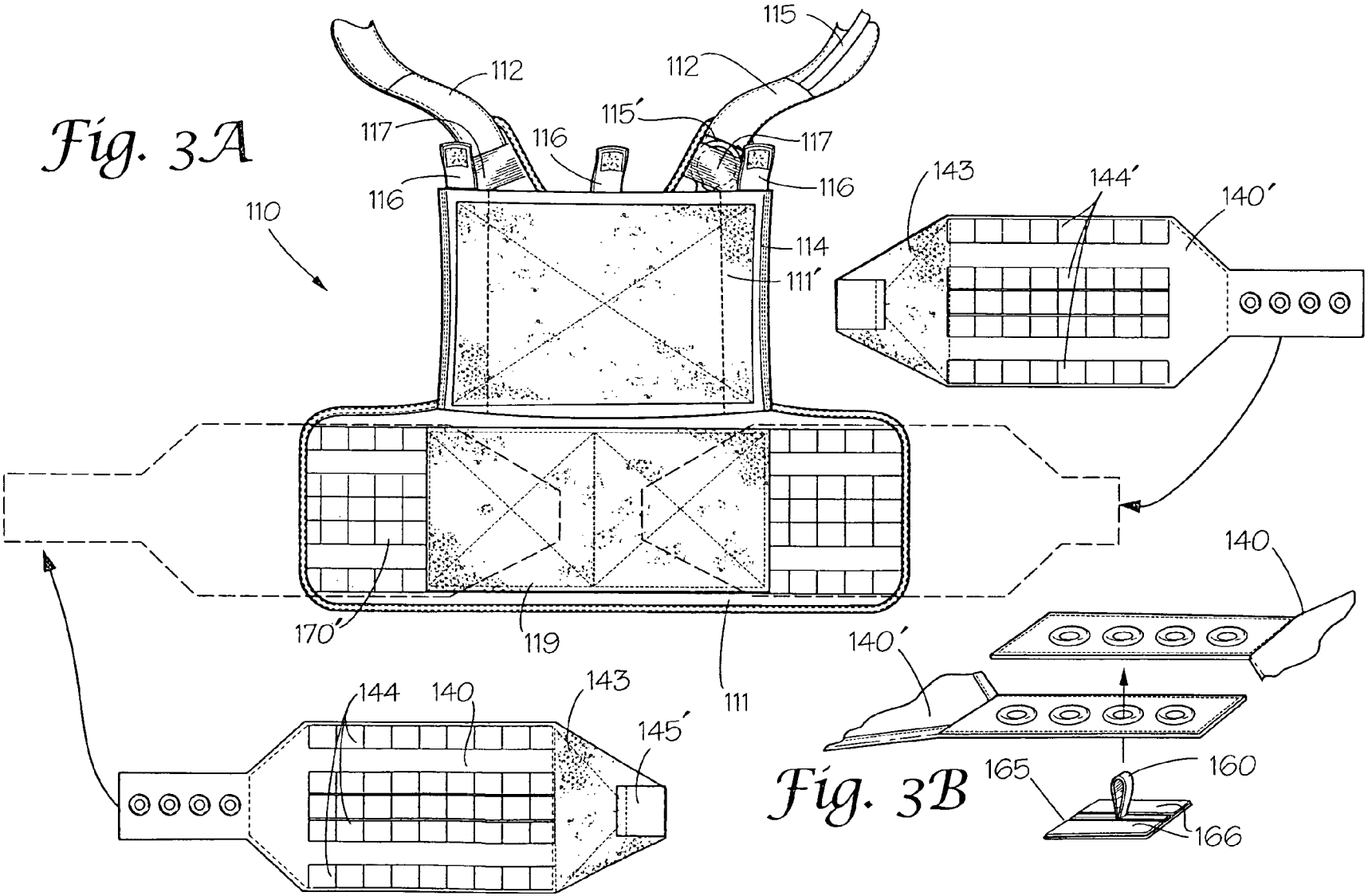
FIG. 3A shows a partially exploded front view of a first exemplary embodiment of a releasable vest, illustrating a front panel flap in an open position, according to this invention.
FIG. 3B shows a partial view of the releasable coupling of the waist belt elements and the release lanyard according to this invention.
Figures 11A, 11B:
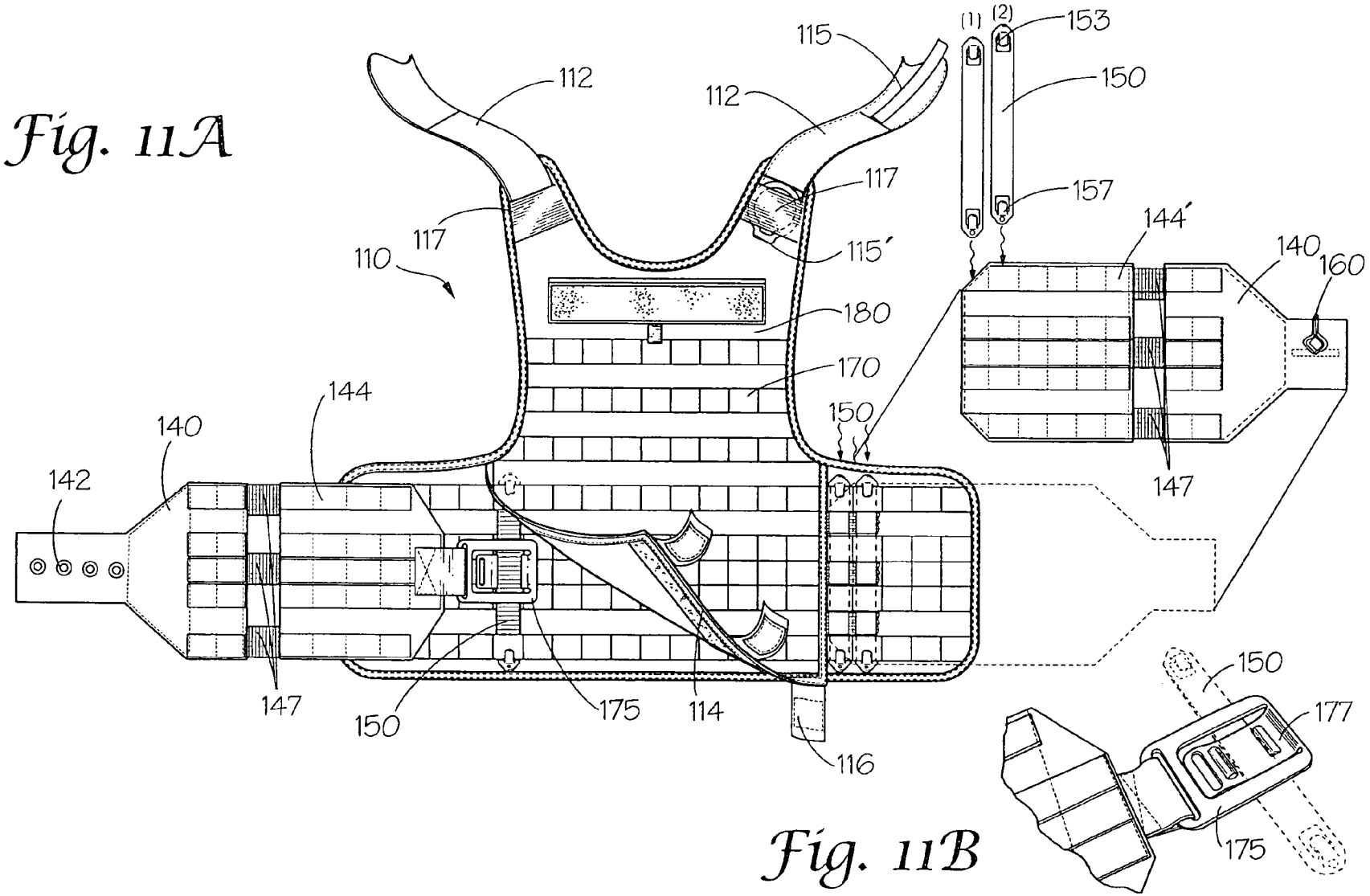
FIG. 11A illustrates a front view of an assembled front panel and waist belt elements of the additional exemplary embodiment of a releasable vest, illustrating the front panel flap in a partially opened position, according to this invention.
FIG. 11B illustrates a more detailed view of the slidably releasable buckle of the additional exemplary embodiment of a releasable vest according to this invention.
Figure 12:
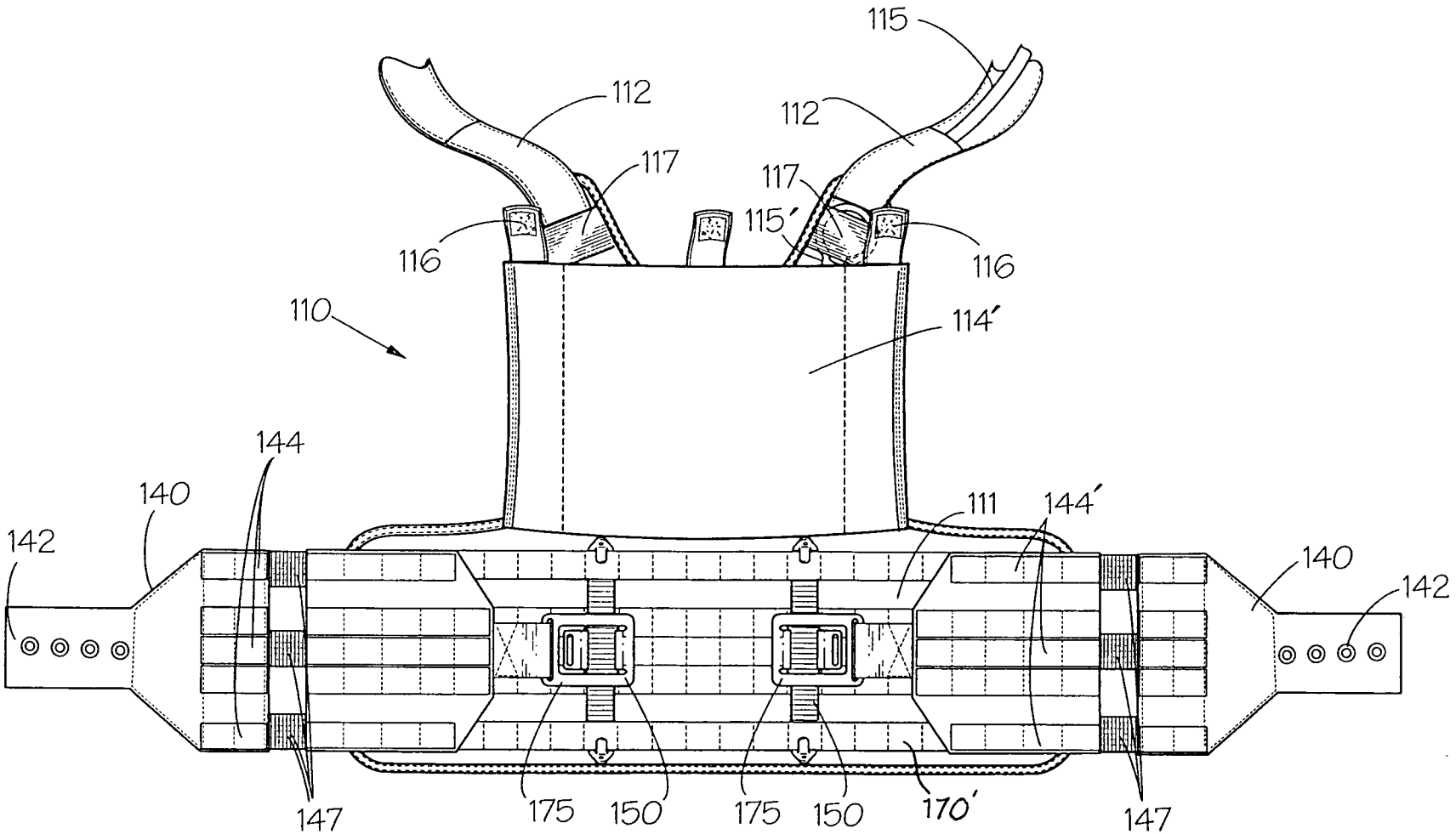
FIG. 12 illustrates a front view of an assembled front panel and waist belt elements of yet another exemplary embodiment of a releasable vest, illustrating the front panel flap in an opened position, according to this invention.

In various exemplary embodiments, as illustrated in FIGS. 3A, 11A, and 12, a MOLLE and/or S.T.R.I.K.E.® compatible accessory mounting portion 170' is included on a portion of the second side of the first layer 111. It should be appreciated that the accessory mounting portion 170' may be provided in an area of the first layer 111 that is capable of being covered by the front panel flap portion 114' of the second layer 114.

Additionally, a MOLLE and/or S.T.R.I.K.E.® compatible accessory mounting portion 170 is included on the second side of the second layer 114.

The back panel 120 comprises at least a first layer 121 and a second layer 124, with a cavity 130 formed between the first layer 121 and the second layer 124. An upper portion of the second layer 124 is attached or coupled to the first layer 121 at an upper portion of the first layer 121. In various exemplary embodiments, as illustrated herein, a lower portion of the second layer 124 extends beyond a point where the second layer 124 is attached or coupled to the first layer 121 to form a back panel flap portion 124' of the second layer 124.

In various exemplary embodiments, a panel coupling means 125 is positioned so as to provide additional coupling of the first layer 121 to the second layer 124. It should be appreciated that, in various exemplary embodiments, the panel coupling means 125 may be any permanent or releasable coupling means, such as, for example, a grommet, a fastener, a stitch or stitched portion, one or more male/female snap-release buckles, one or more buttons, snaps, or other fastening, closure, or attachment means known to those skilled in the art.

The back panel flap portion 124' of the second layer 124 is formed so as to be secured or releasably coupled to the first layer 121 by a releasable coupler 126. In various exemplary embodiments, the releasable coupler 126 may comprise a hook and loop fastener, such as Velcro. It should be appreciated that, in various exemplary embodiments the releasable coupler 126 may comprise other releasable couplers or releasable fasteners, such as, for example, male/female snap-release buckles, a ziplock fastening device, a zipper, buttons, snaps, or other fastening, closure, or attachment means known by those skilled in the art.

In various exemplary embodiments, as illustrated herein, the back panel flap portion 124' may be formed so as to extend beyond a lower portion of the first layer 121 and be releasably coupled to a first side of the first layer 121 (a side of the back panel 120 that faces towards the body of a user wearing the releasable vest 100). Alternatively, the back panel flap portion 124' may be formed so as to be releasably coupled to a second side of the first layer 121 (a side of the back panel 120 that faces away from the body of a user wearing the releasable vest 100).

In various exemplary embodiments, the back panel 120 may also comprise an additional layer of material 122, which provides an additional cushioning or airflow layer to the back panel 120. Furthermore, the back panel 120 may comprise a portion of attachment material 123, such as, for example, a hook and loop fastener, such as Velcro. The inclusion of a portion of attachment material 123 may allow for the releasable attachment of certain additional components, such as, for example, collars or other protective portions, to the back panel 120 of the releasable vest 100.

The back panel 120 comprises a tunnel or cavity 130 formed between at least a portion of the first layer 121 and the second layer 124. In this manner, at least a portion of the front shoulder strap elements 112 can be introduced into an interior of the back panel 120 formed between at least a portion of the first layer 121 and the second layer 124.

The waist belt elements 140 and 140' serve to attach or couple the front panel 110 to the back panel 120. As illustrated in the drawing figures, the first waist belt element 140 is releasably attached or coupled to the first layer 111 of the front panel 110, via the interaction of a releasable fastener 143 on waist belt attachment/adjustment portions 145 of the first waist belt element 140 and corresponding releasable fastener 119 on the first layer 111 of the front panel 110. In various exemplary embodiments, the releasable fastener 143 is positioned on a first side of the first waist belt element 140 proximate a first end of the first waist belt element 140.

In various exemplary embodiments, the releasable fastener 143 and the corresponding releasable fastener 119 comprise mating portions of a hook and loop fastener, such as Velcro®. It should be appreciated that, in various exemplary embodiments, the releasable fastener 143 and the corresponding releasable fastener 119 comprise other attachment means or releasable fasteners, such as, for example, other hook-and-loop fasteners, male/female snap-release buckles, buttons, snaps, or other fastening, closure, or other known or later developed fastening or attachment means.

In various exemplary embodiments, a second portion of a releasable fastener 143' is included on a second side of the first waist belt element 140 proximate the first end of the first waist belt element 140. Additionally, a second portion of corresponding releasable fastener 119' is included on an inner layer of the front panel flap portion 114' of the second layer 114.

In this manner, each of the waist belt elements 140 and 140' can be releasably secured, on a first side, to the releasable fastener 119 on the first layer 111 of the front panel 110. Optionally, each of the waist belt elements 140 and 140' may be further releasably secured, on a second side, to the releasable fastener 119' on an inner layer of the front panel flap portion 114' of the second layer 114.

In various exemplary embodiments, the waist belt elements 140 and/or 140' optionally include one or more elastic portions 147. If included, the elastic portion(s) 147 provide a measure of stretch or flex to the waist belt elements 140 and 140'. While the elastic portion(s) 147 are illustrated as comprising three separate elastic portions attached or coupled between sections of the waist belt elements 140 and/or 140', it should be appreciated that the elastic portion(s) 147 may comprise a single elastic portion attached a couple between sections of the waist belt elements 140 and/or 140'.

As Illustrated in FIGS. 3A, 3B, 13A, and 13B, the release loop 160 is attached or coupled to a portion of fabric or other material 165. In various exemplary embodiments, the release loop 160 comprises a loop made of a fabric, metallic, plastic, or composite material. Optionally, a portion of releasable fastener 166, such as, for example, Velcro®, is included on the top side of the material 165. In this manner, the portion of material 165 may be attached or coupled to a first side of the first waist belt element 140 or the second waist belt element 140', particularly after a portion of the release loop 160 is passed through an appropriate waist belt attachment opening 142.

As further illustrated herein, each of the first waist belt element 140 and the second waist belt element 140' includes one or more waist belt attachment opening(s) 142, which are capable of including or accommodating the release loop 160.

In certain exemplary, non-limiting embodiments, the waist belt attachment opening(s) 142 comprise slits or openings formed through the material of the first waist belt element 140 and the second waist belt element 140'. In certain exemplary embodiments, the waist belt attachment opening(s) 142 are reinforced by, for example, stitching, a grommet, or other reinforced eyelet.

The waist belt attachment opening(s) 142 allow the release loop 160 to pass through the waist belt elements 140 and 140' (as discussed below). In various exemplary embodiments, a single attachment opening 142 may be included on each waist belt elements 140 and 140'. However, a plurality of waist belt attachment opening(s) 142 may be included to allow a user to select a single waist belt attachment opening 142 to pass the release loop 160 through, thereby providing a measure of adjustment to the effective length of the waist belt element 140 or 140' and the overall fit of the releasable vest 100.

The release lanyard 115 comprises an elongate piece of material having a relatively thin profile. By utilizing a release lanyard 115 having a relatively thin profile, the possibility of the release lanyard 115 producing a pressure point on the user is greatly reduced. However, it should be appreciated that the release lanyard 115 may have a round or oval shaped profile. In various exemplary embodiments, the release lanyard 115 comprises a material having a relatively low coefficient of drag.

In various exemplary embodiments, the release lanyard 115 may comprise a single piece of material that extends from a pull handle 115' to a terminal end. Alternatively, the release lanyard 115 may comprise a variety of materials that are attached or coupled together to form the release lanyard 115. For example, the elongate body portion of the release lanyard 115 may be comprised of a different material from a pull handle 115'.

In various exemplary embodiments, a portion of the exterior of the front panel 110, the back panel 120, and/or the waist belt elements 140 and 140' includes MOLLE and/or S.T.R.I.K.E.® compatible webbing. However, it should be appreciated that the inclusion of any such MOLLE and/or S.T.R.I.K.E.® compatible webbing is a design choice based on the desired appearance and functionality of the releasable vest 100.

Figure 4:
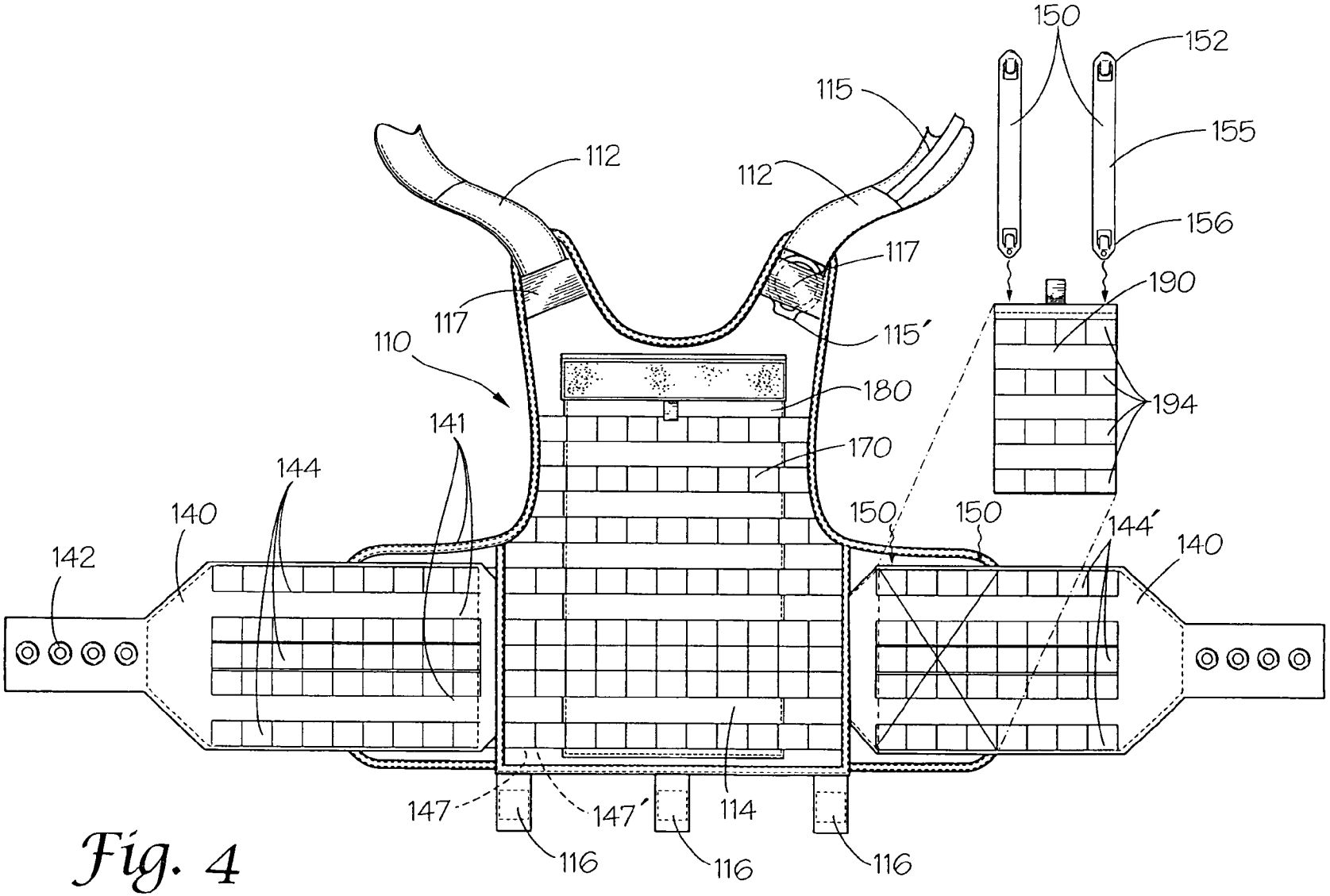
FIG. 4 shows a front view of an assembled front panel and waist belt elements of a first exemplary embodiment of a releasable vest, illustrating the front panel flap in a closed but unsecured position, according to this invention.
Figure 5:
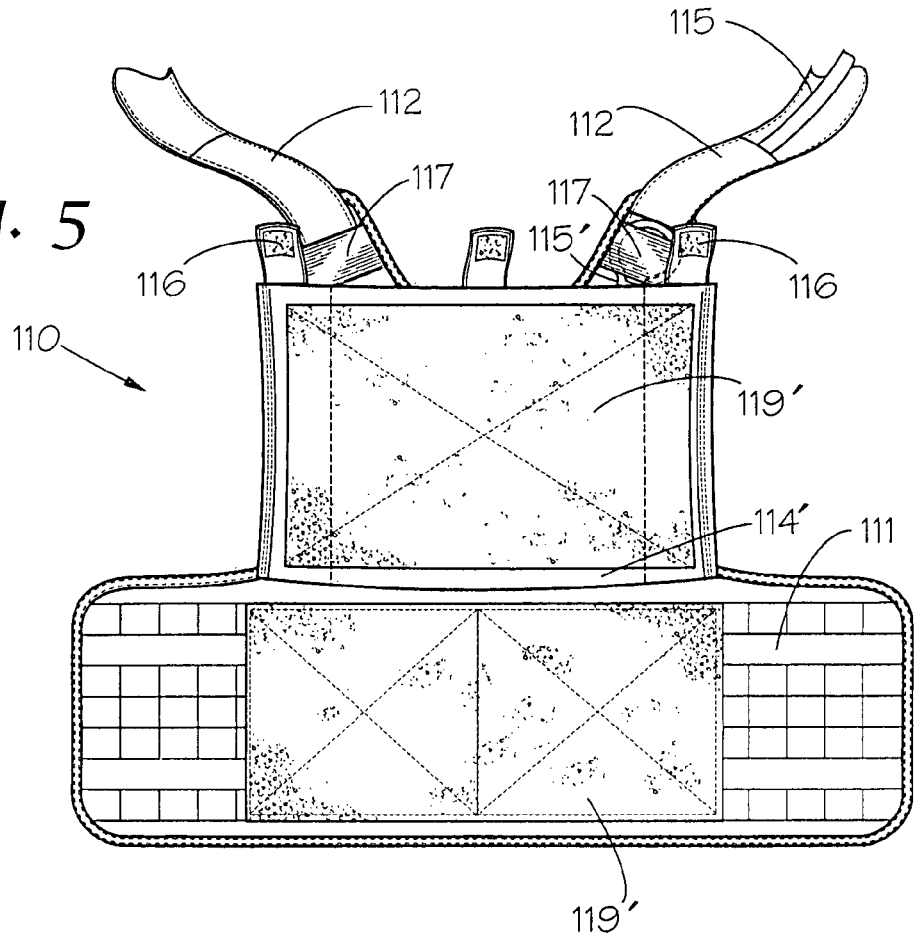
FIG. 5 shows a front view of the front panel of the releasable vest, illustrating a front panel flap in an open position.
Figure 6:
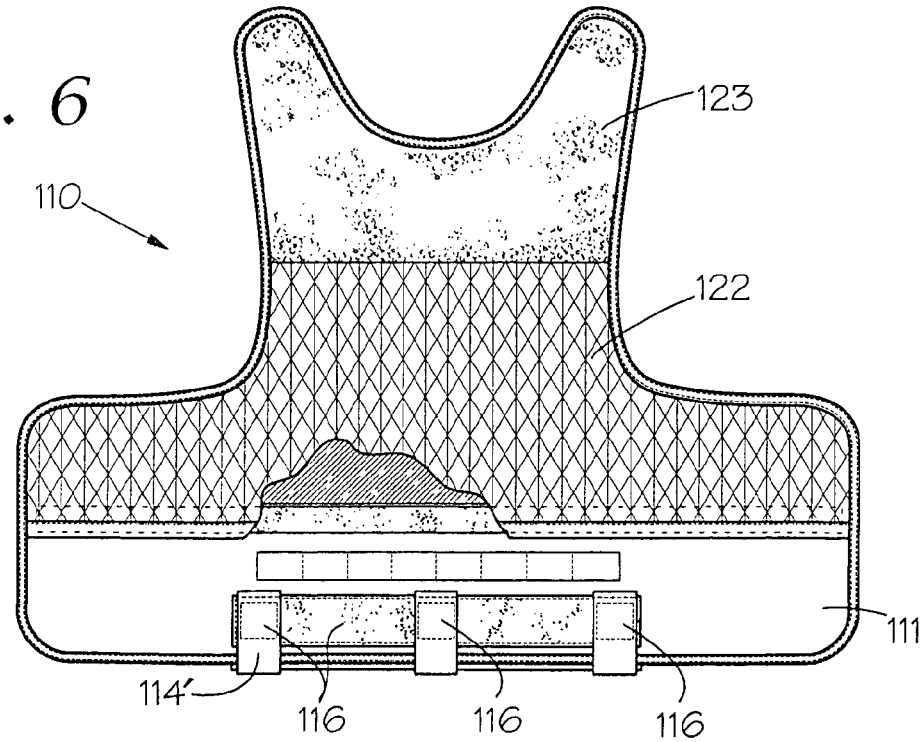
FIG. 6 shows a rear view of the front panel of the releasable vest, illustrating the front panel flap in a closed and secured position.
Figure 7:
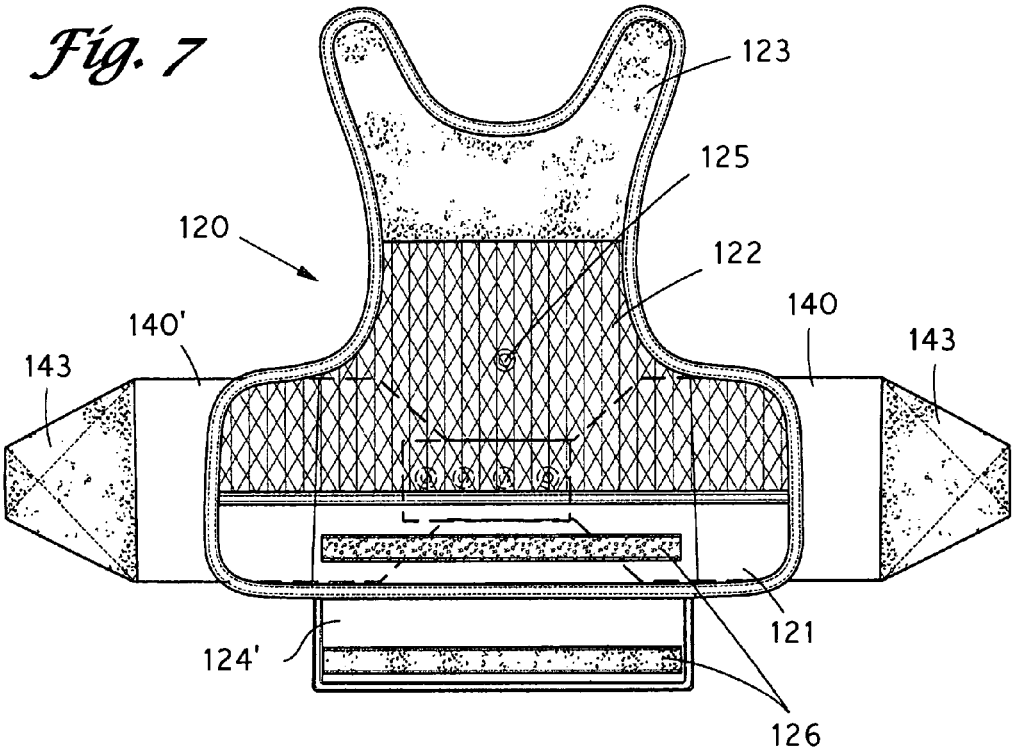
FIG. 7 shows a rear view of the back panel of the releasable vest, illustrating a back panel flap in a closed but unsecured position.
Figure 8:
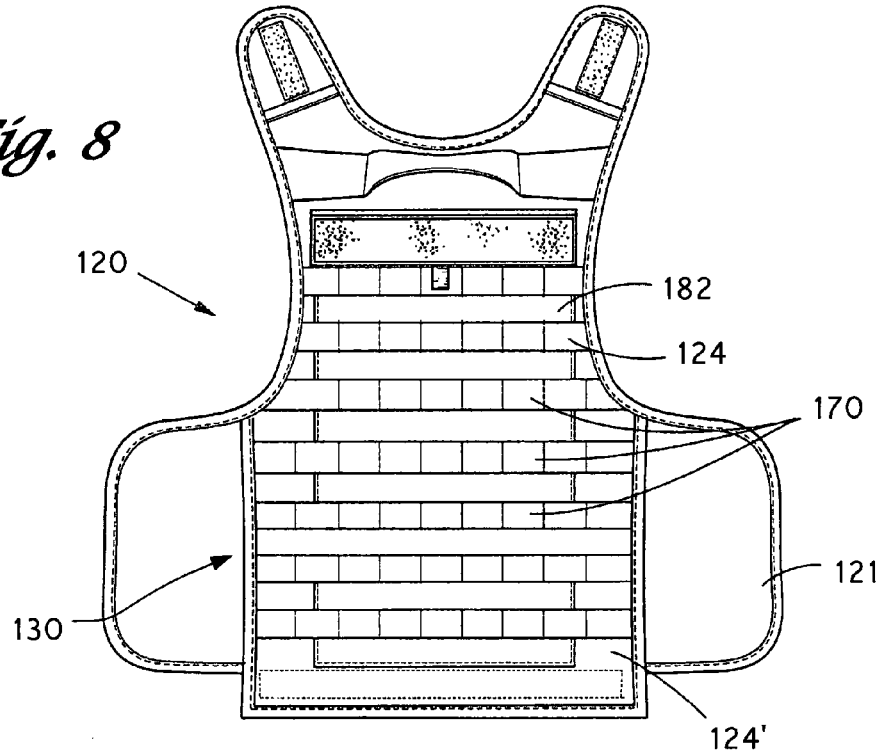
FIG. 8 shows a front view of the back panel of the releasable vest, illustrating the back panel flap in a closed but unsecured position.
Figure 9:
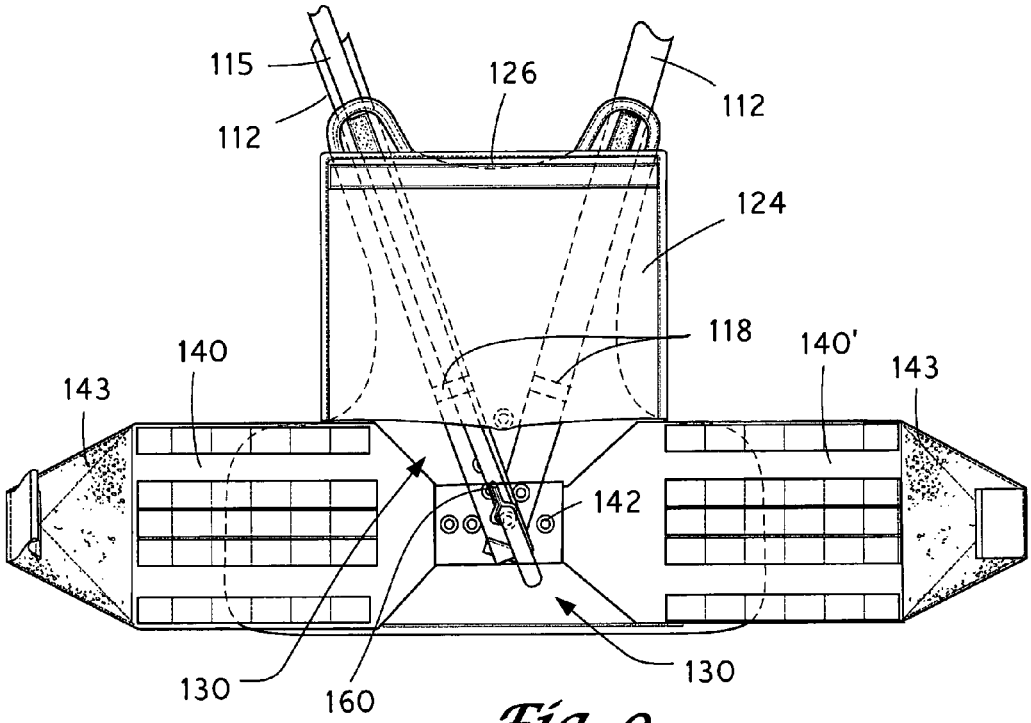
FIG. 9 shows an interior view of the back panel of a first exemplary embodiment of a releasable vest according to this invention, illustrating the back panel flap in an open position and illustrating the releasable coupling of the waist belt elements according to this invention.

If, as illustrated herein, the waist belt elements 140 and 140' include MOLLE and/or S.T.R.I.K.E.® compatible webbing 144 and 144', respectively, an accessory pouch or carrier, such as, for example, an armor plate carrier 190 for holding an armor plate 198 may be coupled to one or both of the waist belt elements 140 and 140'. As illustrated in FIG. 4, an armor plate carrier 190 may be coupled, via coupling members 150, to the second waist belt element 140'. As illustrated, the armor plate carrier 190 is placed adjacent the second waist belt element 140', such that waist belt webbings 144' are within the spaces between spaced apart armor plate carrier webbings 194 (and the armor plate carrier webbings 194 are within spaces between the spaced apart waist belt webbings 144') and corresponding plate carrier tunnel segments and waist belt tunnel segments are aligned, the coupling member 150 may be interwoven between the aligned plate carrier tunnel segments and waist belt tunnel segments to removably couple the second waist belt element 140' to the armor plate carrier webbing 194, similarly to the method described above with reference to FIG. 11A.

It should be appreciated that while the armor plate carrier 190 is illustrated as being coupled to a second side of the second waist belt element 140', the armor plate carrier 190, or any other accessory or accessory carrier, may be coupled to any portion of MOLLE and/or S.T.R.I.K.E.® compatible webbing on the releasable vest 100. For example, the armor plate carrier 190 may be coupled to the MOLLE and/or S.T.R.I.K.E.® compatible accessory mounting portion 170' included on the second side of the first layer 111, such that the armor plate carrier 190 is coupled between the front panel 110 and the first waist belt element 140 or the second waist belt element 140'.

In various exemplary embodiments, the front panel 110, the back panel 120, and/or the waist belt elements 140 and 140' may include a pocket or plate carrier, such as, for example, a front pocket 180 and/or a back pocket 182. However, it should be appreciated that the inclusion of any such pocket or plate carrier is a design choice based on the desired appearance and functionality of the releasable vest 100.

If the back pocket 182 is included, the panel coupling means 125 may serve as a drain hole for the back pocket 182. Additionally, if the front pocket 180 and/or additional waist belt elements 140 and 140' include one or more pockets, additional panel coupling means (not shown) may be included to provide drainage for each of the pockets.

One optional method for assembling the elements of the releasable vest 100 includes first securing the waist belt elements 140 and 140' to the front panel 110, as discussed above.

Then, the back panel flap portion 124' is lifted and the waist belt elements 140 and 140' are positioned atop the lower portion of the first layer 121, such that the release loop 160 can be aligned with and passed through the appropriate waist belt attachment openings 142 of the waist belt elements 140 and 140'.

When the release loop 160 has been passed through the aligned waist belt attachment openings 142, an end of a first front shoulder strap element 112 is introduced into an interior tunnel or cavity 130 of the back panel 120 and passed through the tunnel or cavity 130 of the back panel 120 such that the release loop 160 can be aligned with and passed through an appropriate front shoulder strap attachment opening 113.

When an appropriate front shoulder strap attachment opening 113 has been aligned with the release loop 160, the release loop 160 is passed through the aligned front shoulder strap attachment opening 113.

Figure 13A:
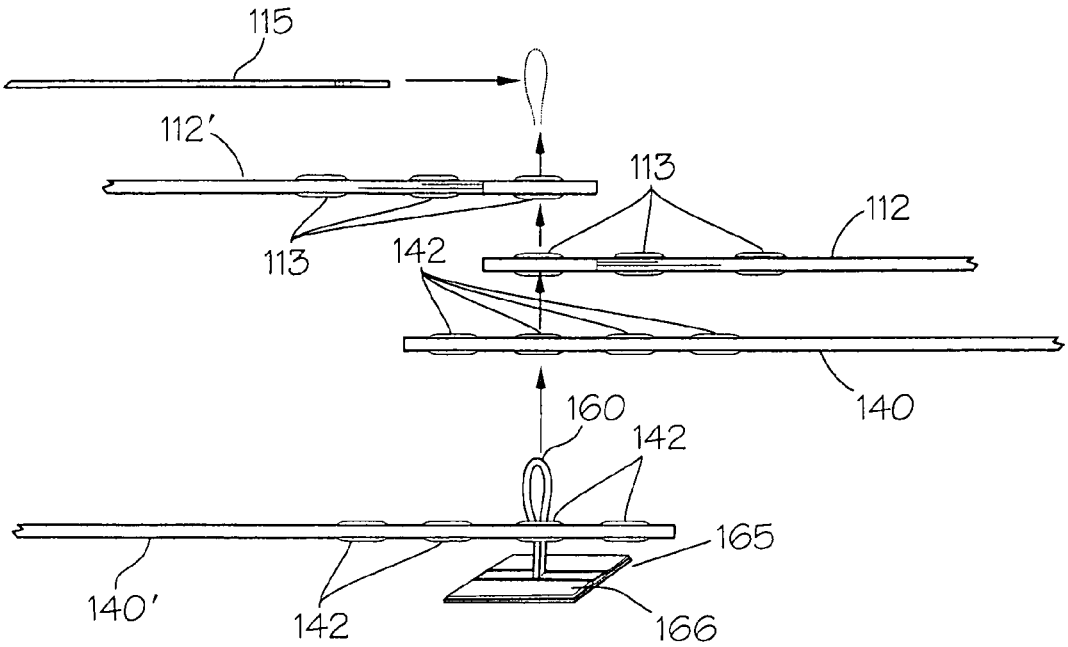
FIG. 13A illustrates a partially exploded view of the slidably releasable coupling of the waist belt elements, shoulder strap elements, and release lanyard according to this invention.
Figure 13B:
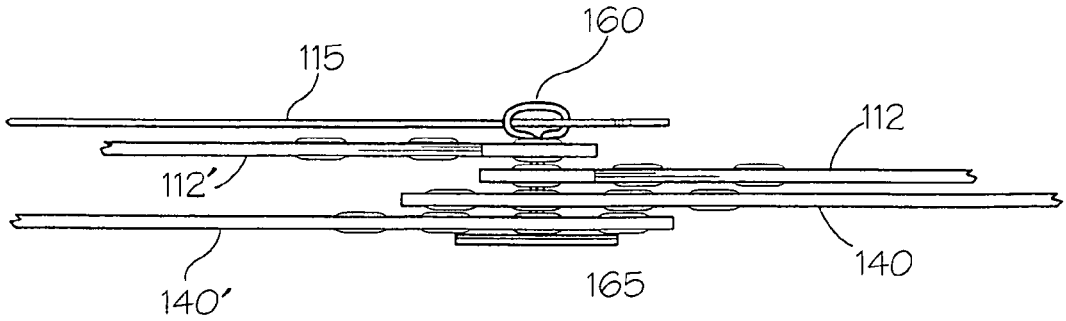
FIG. 13B illustrates an assembled view of the slidably releasable coupling of the waist belt elements, shoulder strap elements, and release lanyard to the second release loop according to this invention.

Once the release loop 160 has been passed through a front shoulder strap attachment opening 113 of a first front shoulder strap element 112 (identified in FIG. 13B as first shoulder strap element 112), an end of a second front shoulder strap element 112 is passed through an interior tunnel or cavity 130 of the back panel 120 and the release loop 160 is passed through an appropriately aligned front shoulder strap attachment opening 113 of the second front shoulder strap element 112 (identified in FIG. 13B as second shoulder strap element 112').

When the release loop 160 has been passed through the desired waist belt attachment opening 142 of the waist belt elements 140 and 140' and the desired front shoulder strap attachment openings 113 of the front shoulder strap elements 112 and 112', a portion of the release lanyard 115 is passed through the release loop 160 to secure the waist belt elements 140 and 140' and the front shoulder strap elements 112 and 112' together, as illustrated in FIGS. 13A and 13B.

In various exemplary embodiments, the release lanyard 115 follows a path that parallels the path taken by one of the front shoulder strap elements 112. To maintain an appropriate position of the release lanyard 115, release lanyard guides, such as, for example, release lanyard guides 118, may be included on various portions of the front shoulder strap elements 112. Alternatively, similar release lanyard guides may be included in the interior of the back panel 120, attached or couple to either the first layer 121 or the second layer 124.

In various exemplary embodiments, the release lanyard 115 is of a sufficient length such that when the releasable lanyard 115 is passed through the release loop 160, the pull handle 115' is at least partially covered by a release lanyard cover 117. The release lanyard cover 117 provides at least some measure of security that the release lanyard 115 is not accidentally pulled.

In various exemplary embodiments, at least a portion of the release lanyard 115 includes a frictional surface (not shown). The frictional surface, if included, can provide a certain amount of resistance to the release lanyard 115 being pulled from the releasable vest 100 and/or the release lanyard cover 117, when the releasable vest 100 is fully assembled.

It should be appreciated that the order in which the components of the releasable vest 100 are described as being assembled may be altered so that a user is able to achieve the best fit of the releasable vest 100. For example, as described in shown herein, the release loop 160 may be releasably coupled to the remaining first waist belt element 140 before the release loop 160 is releasably coupled to the shoulder strap elements 112. Alternatively, the release loop 160 may first be releasably coupled to the shoulder strap elements 112 before the release loop 160 is releasably coupled to the remaining first waist belt element 140.

When the waist belt elements 140 and 140' and the shoulder strap elements 112 and 112' have been releasably coupled, via the releasable lanyard 115, to the releasable loop 160, the back panel flap portion 124' is closed and secured, via releasable coupler 126, to the first layer 121.

Because the assembled combination of the waist belt elements 140 and 140' and the shoulder strap elements 112 is relatively free-floating with respect to the back panel 120, the panel coupling means 125, if included, may provide an upper limit for the assembled combination of the waist belt elements 140 and 140' and the shoulder strap elements 112, such that these elements may be held in a desired position relative to the back panel 120.

When the elements of the releasable vest 100 have been assembled, the assembled releasable vest 100 may be donned or removed by a user utilizing the waist belt attachment/adjustment portions 145. Alternatively, if the waist belt elements 140 and/or 140' are formed integral to the front panel 110, an elastic portion of the waist belt elements 140 and/or 140' may provide sufficient flex to allow the releasable vest 100 to be donned or removed by the user.

If a wearer wishes to quickly remove the releasable vest 100, the releasable lanyard 115 need only be pulled a relatively short distance. When the pull handle 115' of the releasable lanyard 115 is pulled, the release lanyard 115 is slidably pulled from the release loop 160, and the waist belt elements 140 and 140' and front shoulder strap elements 112 are able to separate from the release loop 160, and the back panel 120. Thus, when the pull handle 115' is pulled, the elements of the releasable vest 100 are released and the vest can "fall away" from the body of the user.

In various exemplary embodiments, the releasable vest 100 may further comprise a second, safety lanyard (not shown), which may also be slidably passed through the release loop 160. The safety lanyard operates similarly to the release lanyard 115. However, the safety lanyard, if utilized, requires that a second obstruction be removed from the release loop 160 before the elements of the releasable vest 100 are able to separate from the release loop 160.

In certain exemplary embodiments, the safety lanyard may comprise a loop of material or a ring, such as, for example, a locking or snap carabiner, that is slidably passed through the release loop 160 after the elements of the releasable vest 100 have been slidably releasably coupled to the release loop 160. In various exemplary embodiments, release of the safety lanyard may require access through the back panel flap portion 124'.

It is possible that a safety lanyard be used in place of the release lanyard 115. In this manner, the releasable features and capabilities of the vest are overcome and the elements remain coupled until the safety lanyard is removed.

In various exemplary embodiments, instructions for assembling and/or operating the releasable vest 100 may be included on the first layer 121 or on an inside layer or surface of the back panel flap portion 124'. In this manner, when the back panel flap portion 124' is lifted so that a user is able to assemble the components of the releasable vest 100, instructions for the assembly and/or operation of the releasable vest 100 are provided. The instructions may be provided in written, pictorial, diagram, or a combination of forms.

Alternatively, instructions for assembling and/or operating the releasable vest 100 may be included on the second layer 124 of the back panel 120. The instructions may be provided in written, pictographic, diagram, symbolic, or a combination of forms and may, for example, include a pictorial outline of certain of the components illustrating the relationship of each of the components when assembled or illustrating how the components are to be assembled.

While optional instructions have been described as being included on the inside layer or surface of the back panel flap portion 124' or the first layer 121 of the back panel 120, the optional instructions may be included on any covered or exposed surface of any component of the releasable vest 100.

While not illustrated herein, in various exemplary embodiments, the releasable vest 100 may comprises a first release loop 160 and a second release loop 162 (not shown), both of which are attached or coupled to one of the waist belt elements 140 and 140'. It should be appreciated that the first release lanyard 160 and the second release loop 162 (not shown) operate similarly to the release loop 160, as described above.

However, with the inclusion of the second release loop 162 (not shown), certain components may be releasably coupled to the first release loop 160 while certain other components are releasably coupled to the second release loop 162 (not shown). For example, the remaining first waist belt element 140 may be releasably slidably coupled to the first release loop 160, while the front shoulder strap elements 112 may be releasably slidably coupled to the second release loop 162 (not shown).

In this manner, the releasable lanyard 115 may be passed through the first release loop 160 and a second release loop 162 (not shown) to secure the front shoulder strap elements 112 and the waist belt elements 140 and 140', respectively.

Utilizing a first release loop 160 and a second release loop 162 (not shown), when the release lanyard 115 is pulled a first distance, the elements of the releasable vest 100 that are coupled to the first release loop 160 are able to separate from the first release loop 160. Then, when the release lanyard 115 is pulled a second distance, the elements of the releasable vest 100 that are coupled to the second release loop 162 (not shown) are able to separate from the second release loop 162 (not shown).

In this manner, certain of the components of the releasable vest 100 are released from the assembled relationship when the release lanyard 115 is pulled a first predetermined distance. When the release lanyard 115 is pulled a second predetermined distance, certain remaining components of the releasable vest 100 are released from the assembled relationship.

If, for example, the release lanyard 115 is accidentally pulled, it is possible that only one of the waist belt elements 140 will be released from the second release loop 162 (not shown), alerting the user to the fact that the release lanyard 115 has been accidentally pulled, before all of the elements of the releasable vest 100 are released from their assembled relationship.

Figure 10:
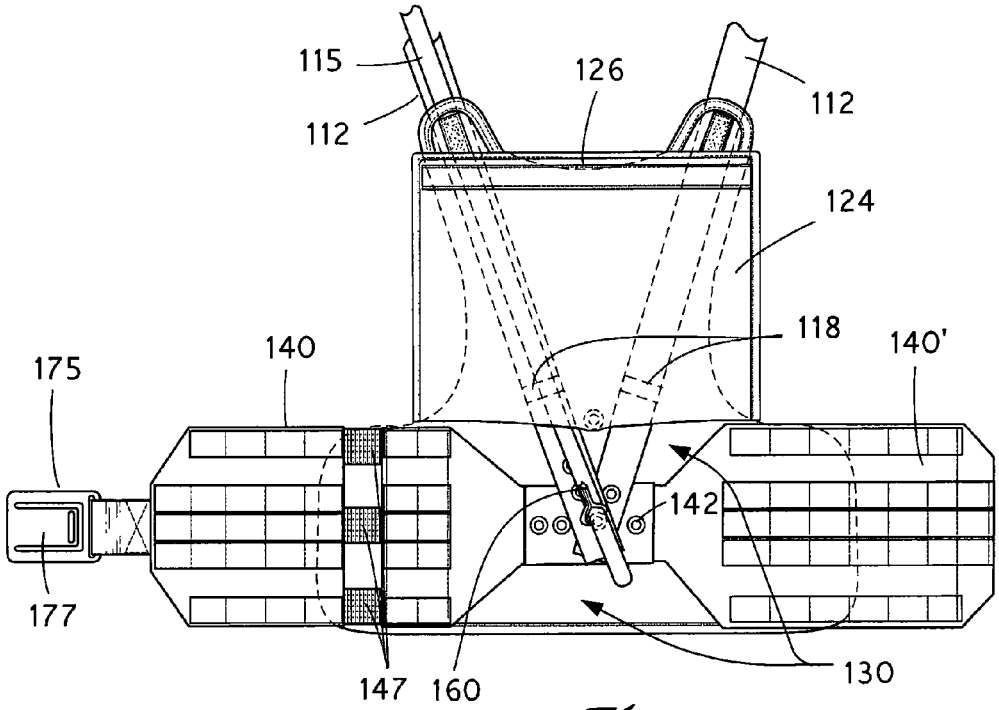
FIG. 10 shows an interior view of the back panel of an additional exemplary embodiment of a releasable vest according to this invention, illustrating the back panel flap in an open position and illustrating the releasable coupling of the shoulder strap elements according to this invention.

FIGS. 10 through 12 show an additional exemplary embodiment of a releasable vest according to this invention. As illustrated in FIGS. 10 through 12, the releasable fastener 143 and 143' on waist belt attachment/adjustment portions 145 and 145' of the waist belt elements 140 and 140', as well as the corresponding releasable fastener 119 on the first layer 111 of the front panel 110 are removed. As illustrated in FIGS. 10 through 12, the releasable fastener 143 and 143' is replaced by a buckle 175 having a buckling element 177. Furthermore, the releasable fastener 119 is replaced by a MOLLE and/or S.T.R.I.K.E.® compatible accessory mounting portion 170' that extends through in an area of the first layer 111 that is capable of being covered by the front panel flap portion 114' of the second layer 114.

Thus, the first waist belt element 140 is releasably coupled or attached to the first layer 111 of the front panel 110, via a coupling member 150.

Each coupling member 150 comprises an elongate portion of material having a first end portion 152, an intermediate portion 155, and a second end portion 156. As illustrated in FIG. 11A, a hook 153 is formed integral to a portion of the first end portion 152 and a hook 157 is formed integral to a portion of the second end portion 156.

In various exemplary, non-limiting embodiments, the coupling member 150 comprises a coupling member as described in U.S. patent application Ser. No. 11/703,882, entitled Modular Equipment Coupler, filed Feb. 8, 2007, the disclosure of which is incorporated herein by reference.

As illustrated in FIGS. 10 through 12, the first waist belt element 140, and possibly the second waist belt element 140' is coupled to the first layer 111 of the front panel 110, via the accessory mounting portion 170'.

In order to couple the waist belt element 140 and/or 140' to the front panel 110, the waist belt element 140 or 140', the coupling member 150 is first interwoven between panel tunnel segments (or merely inserted between the MOLLE and/or S.T.R.I.K.E.® compatible webbing segments and the surface of the front panel 110) to removably couple the coupling member 150 to the accessory mounting portion 170'.

Once the coupling member 150 has been removably coupled to the accessory mounting portion 170', the hooks 153 and 157 may optionally be placed around a first and/or a last accessory mounting portion 170', respectively, to further secure the coupling member 150 within the panel tunnel segments.

It should be understood that since the total number of spaced apart accessory mounting portions 170' may vary, the total length of the coupling member 150 may vary.

Once the coupling member 150 has been removably coupled to the accessory mounting portion 170', the buckle 175 can be attached to the coupling member 150, as illustrated in FIGS. 11A through 12.

It should be appreciated that, as illustrated in FIGS. 10 through 11B, the buckle 175 may be used to attach or couple only one waist belt element 140 or 140' to the accessory mounting portion 170'. Alternatively, as illustrated in FIG. 12, the buckle 175 may be utilized in connection with the first waist belt element 140 and the second waist belt element 140' and used to separately attach or couple both waist belt elements 140 and 140' to the accessory mounting portion 170'.

FIGS. 13A and 13B show a more detailed view of a release loop 160 being utilized in conjunction with the waist belt elements 140 and 140', the front shoulder strap elements 112 and 112', and the release lanyard 115 according to this invention.

As illustrated in FIGS. 13A and 13B, the release loop 160 is attached or coupled to a portion of material 165. The overall size and shape of the portion of the material 165 is such that the attached release loop 160 will not be pulled through any of the waist belt attachment openings 142 or the shoulder strap attachment openings 113.

The optional portion of releasable fastener 166, included on the top side of the material 165, allows the portion of material 165 to be attached or coupled to a first side of the first waist belt element 140 or the second waist belt element 140', particularly after a portion of the release loop 160 is passed through an appropriate waist belt attachment openings 142.

Alternatively, the material 165 may include an aperture or other means formed in or on the material 165 that allows the material 165 to be attached or coupled to a portion of a waist belt element or other element of the vest 100. In this manner, the material 165 and release loop 160 may be kept with an element of the vest 100 so as not to be inadvertently lost. For example, a piece of 550 cord may be used to couple the material 165 to the second waist belt element 140'.

In certain exemplary embodiments, the material 165 may comprise a loop or ring of material, such as metal or plastic loop or ring, that is attached or coupled to the release loop 160 such that the overall size and shape of the loop or ring is such that the attached release loop 160 will not be pulled through any of the waist belt attachment openings 142 or the shoulder strap attachment openings 113. Alternatively, the release loop may be knotted at one end, stitched over upon itself, or stitched to another material so as to provide sufficient size to a portion of the release loop 160 such that the release loop 160 will not be pulled completely through any of the waist belt attachment openings 142 or the shoulder strap attachment openings 113.

As illustrated, the release loop 160 may comprise a loop of material, such as, for example, 550 cord or webbing material, that is sewn or otherwise attached to the portion of material 165 such that the release loop 160 is kept from passing through the waist belt attachment openings 142.

In these exemplary embodiments, both the first waist belt element 140 and the second waist belt element 140' include one or more waist belt attachment opening(s) 142. During assembly, the appropriate waist belt attachment openings 142 and the appropriate front shoulder strap attachment openings 113 are aligned and the release loop 160 is passed through the aligned waist belt attachment openings 142 and front shoulder strap attachment opening 113. Once a portion of the release loop 160 has passed through the openings, sufficient that a portion of the release lanyard 115 may be passed through the release loop 160 to secure the waist belt elements 140 and 140' and the front shoulder strap elements 112 and 112' together, the release loop 160 is maintained in position via the release lanyard 115 and the knot or other obstruction formed in the release loop 160.

Figure 14:
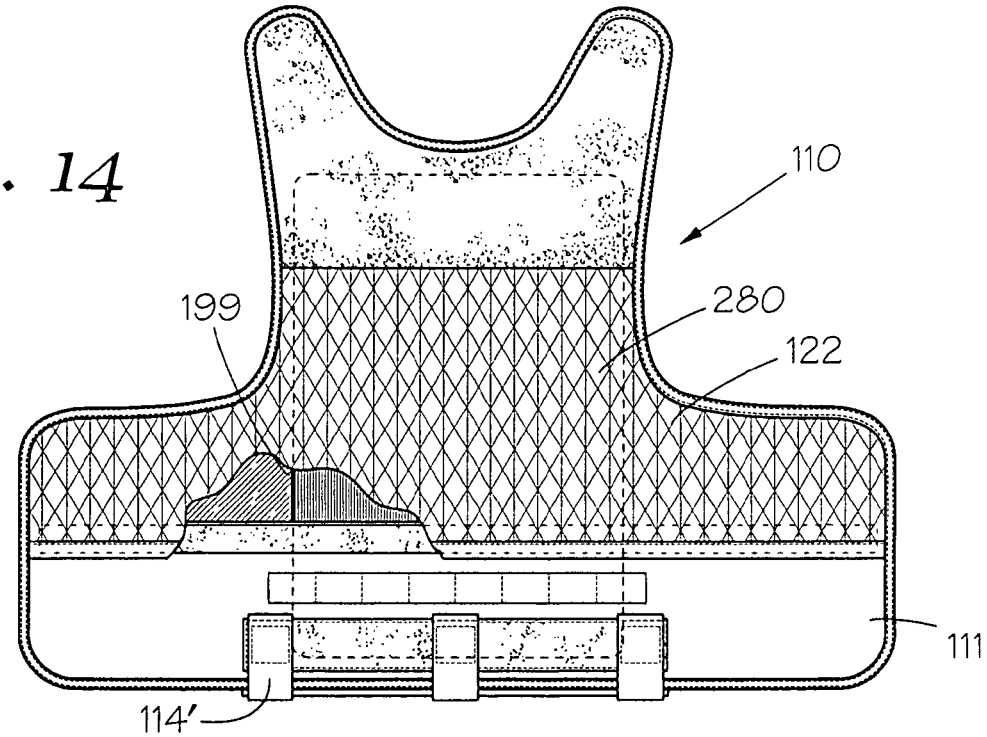
FIG. 14 shows a rear view of the front panel of an exemplary embodiment of the releasable vest, wherein the front panel includes an internal pocket.
Figure 15:
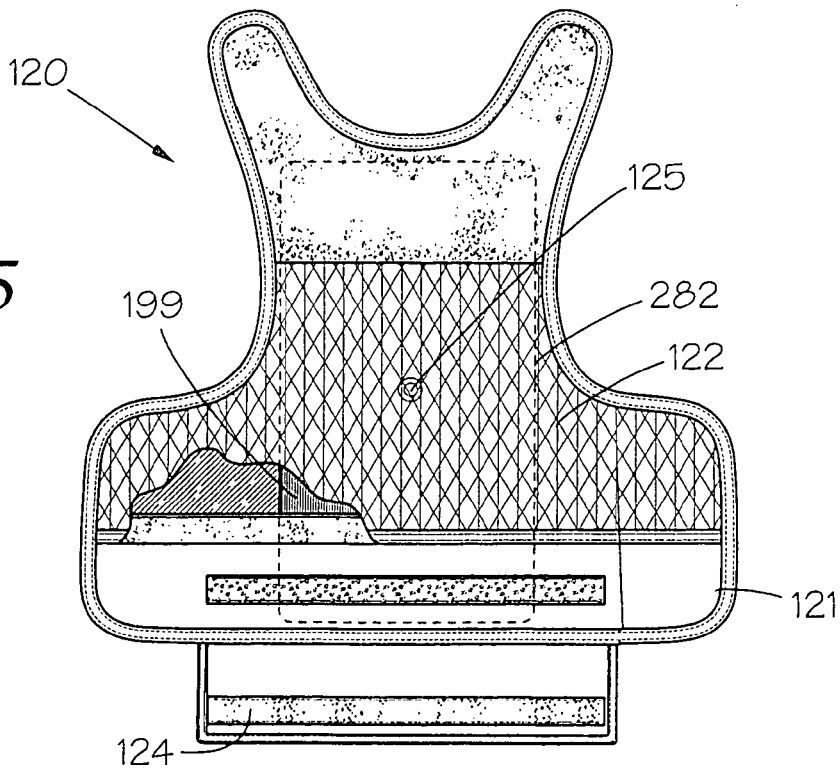
FIG. 15 shows a rear view of the back panel of an exemplary embodiment of the releasable vest, wherein the back panel includes an internal pocket.

FIGS. 14 and 15 show exemplary embodiments of a releasable vest wherein the exemplary front pocket 180 and back pocket 182 are replaced or supplemented by a front internal pocket 280 and a back internal pocket 282, respectively. In these exemplary embodiments, the first layer 111 of the front panel 110 comprises a front internal pocket 280, which is accessible when the front panel flap portion 114' of the second layer 114 is opened. Likewise, the first layer 121 of the back panel 120 comprises a back internal pocket 282, which is accessible when the back panel flap portion 124' of the second layer 124 is opened.

Items, such as, for example, body armor plates 199 may be inserted in the front internal pocket 280 and/or the back internal pocket 282. Once the items are inserted, the front panel flap portion 114' and/or the back panel flap portion 124' can be closed to secure the items within the front internal pocket 280 and/or the back internal pocket 282.

It should be appreciated that the inclusion of any external and/or internal pocket or plate carrier is a design choice based on the desired appearance and functionality of the releasable vest 100.

While this invention has been described in conjunction with the exemplary embodiments outlined above, it is evident that many alternatives, modifications, and variations will be apparent to those skilled in the art. Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, is intended to be illustrative, not limiting. Various changes, modifications, and/or adaptations may be made without departing from the spirit and scope of this invention.

What is claimed is:

1. A releasable vest, comprising:

a front panel comprising at least a first layer and a second layer, wherein the first layer of the front panel includes at least a portion of a releasable fastener, wherein a portion of the second layer is attached or coupled to a portion of the first layer, and wherein a portion of the second layer extends beyond an area where the second layer is attached or coupled to the first layer to form a front access panel portion of the second layer;

shoulder strap elements that extend from the front panel, wherein each of the shoulder strap elements includes at least one shoulder strap attachment opening formed therethrough;

a back panel comprising at least a first layer and a second layer, wherein a portion of the second layer is attached to a portion of the first layer such that a cavity is formed between at least a portion of the first layer and a portion of the second layer such that at least a portion of the shoulder strap elements is introduced into the cavity, and wherein a portion of the second layer extends beyond an area where the second layer is attached or coupled to the first layer to form a back access panel portion of the second layer, wherein a releasable coupler releasably couples a portion of the back access panel portion of the second layer to a portion of the first layer, and wherein a panel coupling means permanently couples the first layer of the back panel to the second layer of the back panel;

a first waist belt element releasably attached or coupled, via interaction between the releasable fastener of the first layer of the front panel and corresponding releasable fastener of the first waist belt element, to a portion of the front panel such that the first waist belt element extends from a portion of the front panel, wherein the first waist belt element comprises at least one waist belt element attachment opening formed therethrough, and wherein a portion of the front access panel portion of the second layer is releasably coupled to a portion of the first layer so as to cover at least a portion of the first waist belt element;

a second waist belt element releasably attached or coupled, via interaction between the releasable fastener of the first layer of the front panel and corresponding releasable fastener of the second waist belt element, to a portion of the front panel such that the second waist belt element extends from a portion of the front panel, wherein the second waist belt element comprises at least one release loop, wherein the at least one release loop is capable of being aligned with and passed through the waist belt attachment opening of the first waist belt element and the at least one shoulder strap attachment opening of each of the shoulder strap elements; and a release lanyard, wherein the release lanyard extends from a pull handle to a terminal end, wherein at least a portion of the release lanyard is capable of being aligned with and passed through the release loop so as to releasably secure the first waist belt element and the shoulder strap elements to the release loop, and wherein the panel coupler is located proximate a central portion of the back panel and provides an upper limit for an assembled combination of the first waist belt element, the second waist belt element, and the shoulder strap elements.

2. The releasable vest of claim 1, wherein the shoulder strap elements are formed as an integral part of the front panel.

3. The releasable vest of claim 1, wherein the at least one release loop is attached directly to a surface of the second waist belt element.

4. The releasable vest of claim 1, wherein each of the shoulder strap elements includes a plurality of shoulder strap attachment openings.

5. The releasable vest of claim 1, wherein the shoulder strap attachment openings are reinforced by stitching, a grommet, or a reinforced eyelet.

6. The releasable vest of claim 1, wherein the release loop is not passed through the first layer or the second layer of the back panel.

7. The releasable vest of claim 1, wherein the panel coupler comprises a grommet, a stitch, or a stitched portion.

8. The releasable vest of claim 1, wherein the front access panel portion of the second layer extends beyond a portion of the first layer and is releasably coupled to a second side of the first layer.

9. The releasable vest of claim 1, wherein the back access panel portion of the second layer extends beyond a portion of the first layer and is releasably coupled to a second side of the first layer.

10. The releasable vest of claim 1, wherein the second waist belt element is removably coupled, via one or more coupling members, to MOLLE or S.T.R.I.K.E.® compatible accessory mounting portions formed on the front panel.

11. The releasable vest of claim 1, wherein the waist belt elements include an elastic portion to allow for a measure of expansion of the waist belt elements.

12. The releasable vest of claim 1, wherein each of the waist belt elements includes a plurality of waist belt attachment openings.

13. The releasable vest of claim 1, wherein the release loop comprises a fabric, metallic, plastic, or composite material.

14. The releasable vest of claim 1, wherein the releasable fastener and the corresponding releasable fastener comprise mating portions of a hook and loop fastener, male/female snap-release buckles, buttons, or snaps.

15. The releasable vest of claim 1, wherein at least one waist belt element includes a buckle that is capable of being releasably attached, via a coupling member, to the front panel.

16. A releasable vest, comprising:

a front panel comprising at least a first layer and a second layer, wherein the first layer of the front panel includes at least a portion of a releasable fastener, wherein an upper portion of the second layer is attached to the first layer, and wherein a portion of the second layer extends beyond an area where the second layer is attached or coupled to the first layer to form a front access panel portion of the second layer;

shoulder strap elements that extend from the front panel, wherein each of the shoulder strap elements includes at least one shoulder strap attachment opening formed therethrough;

a back panel comprising at least a first layer and a second layer, wherein an upper portion of the second layer is attached to the first layer such that a cavity is formed between at least a portion of the first layer and the second layer such that at least a portion of the shoulder strap elements is introduced into the cavity formed between at least a portion of the first layer and the second layer, and wherein a portion of the second layer extends beyond an area where the second layer is attached or coupled to the first layer to form a back access panel portion of the second layer, wherein a releasable coupler releasably couples the back access panel portion of the second layer to the first layer, and wherein a panel coupling means coupler couples the first layer of the back panel directly to the second layer of the back panel;

a first waist belt element releasably attached or coupled, via interaction between the releasable fastener of the first layer of the front panel and corresponding releasable fastener of the first waist belt element, to a portion of the front panel such that the first waist belt element extends from a portion of the front panel, wherein the first waist belt element comprises at least one waist belt element attachment opening formed therethrough, and wherein a releasable coupler releasably couples the front access panel portion of the second layer to the first layer so as to cover at least a portion of the first waist belt element;

a second waist belt element releasably attached or coupled, via interaction between the releasable fastener of the first layer of the front panel and corresponding releasable fastener of the second waist belt element, to a portion of the front panel such that the second waist belt element extends from a portion of the front panel, and wherein the second waist belt element comprises at least one waist belt element attachment opening formed therethrough;

a release loop having an associated obstruction of a sufficient size and shape so as to keep a portion of the release loop from passing through the waist belt attachment openings of the first waist belt element and the second waist belt element, wherein at least a portion of the release loop is capable of being aligned with and passed through the at least one waist belt attachment opening of each of the waist belt elements and the at least one shoulder strap attachment opening of each of the shoulder strap elements; and a release lanyard, wherein the release lanyard extends from a pull handle to a terminal end, wherein at least a portion of the release lanyard is capable of being aligned with and passed through the release loop so as to releasably secure the first waist belt element and the at least one shoulder strap element to the release loop, and wherein the panel coupler is located proximate a central portion of the back panel and provides an upper limit for an assembled combination of the first waist belt element, the second waist belt element, and the shoulder strap elements.

17. The releasable vest of claim 16, wherein at least one waist belt element includes a buckle that is capable of being releasably attached, via a coupling member, to the front panel.

18. The releasable vest of claim 16, wherein the panel coupler comprises a grommet, a stitch, a stitched portion, one or more male/female snap-release buckles, one or more buttons, or one or more snaps.

19. The releasable vest of claim 16, wherein the release loop is not passed through the first layer or the second layer of the back panel.

20. The releasable vest of claim 16, wherein the associated obstruction comprises a portion of material attached or coupled to the release loop, wherein the portion of material is of a sufficient size and shape so as to keep a portion of the release loop from passing through the waist belt attachment openings of the first waist belt element and the second waist belt element.

* * * * *

UNITED STATES PATENT AND TRADEMARK OFFICE

CERTIFICATE OF CORRECTION

PATENT NO. : 8,898,814 B2
APPLICATION NO. : 12/735479
DATED : December 2, 2014
INVENTOR(S) : Frederick W. Storms, Jr. et al.

It is certified that error appears in the above-identified patent and that said Letters Patent is hereby corrected as shown below:

In the Claims

Claim 16, under Column 15, Line 39, delete the term "coupler" before the phrase "couples the first layer of the back panel directly".

Signed and Sealed this
Third Day of March, 2015

Michelle K. Lee

Michelle K. Lee
*Deputy Director of the United States Patent and Trademark Office*